US007331165B1

(12) United States Patent
Yu et al.

(10) Patent No.: US 7,331,165 B1
(45) Date of Patent: Feb. 19, 2008

(54) PACKING MACHINE WITH AN ADJUSTABLE BAND-COMPRESSING STROKE

(75) Inventors: Teng-Chi Yu, Taichung (TW); Hsiu-Tzu Lin, Taichung (TW)

(73) Assignee: Hsiu-Man Yu Chen

( * ) Notice: Subject to any disclaimer, the term of this patent is extended or adjusted under 35 U.S.C. 154(b) by 0 days.

(21) Appl. No.: 11/590,912

(22) Filed: Nov. 1, 2006

(51) Int. Cl.
*B65B 13/24* (2006.01)
*B65B 13/34* (2006.01)

(52) U.S. Cl. ..... 53/592; 53/582; 100/29; 100/30; 140/93.2; 140/93.4

(58) Field of Classification Search ..... 53/580, 53/582, 592; 100/29, 30, 32, 33 PB; 140/93.2, 140/93.4
See application file for complete search history.

(56) References Cited

U.S. PATENT DOCUMENTS 3,327,619 A * 6/1967 Sellman ..... 100/29
3,944,460 A * 3/1976 Karr ..... 53/592
5,029,433 A * 7/1991 Werk ..... 53/592
6,332,306 B1 * 12/2001 Finzo et al. ..... 53/592
6,412,257 B1 * 7/2002 Liu et al. ..... 53/592
6,463,847 B1 * 10/2002 Rauch ..... 100/29
6,516,715 B1 * 2/2003 Reiche ..... 53/592
6,564,701 B1 * 5/2003 Liu et al. ..... 53/592
6,684,761 B2 * 2/2004 Yu Chen ..... 53/592
6,688,085 B2 * 2/2004 Yu Chen ..... 53/592
6,904,684 B2 * 6/2005 Chen ..... 100/29
7,100,499 B2 * 9/2006 Yu Chen ..... 53/592

* cited by examiner

*Primary Examiner*—Stephen F. Gerrity
(74) *Attorney, Agent, or Firm*—Ming Chow; Sinorica, LLC

(57) ABSTRACT

A packing machine with an adjustable band-compressing stroke includes a compressing base provided with an accommodating chamber for installing a pulley, and a compressing device. A shaft passes through the pulley and two penetrating holes bored in two sides of the accommodating chamber. A compressing block is set under the pulley. The compressing device is composed of a compressing handle, a compressing bar, an eccentric shaft fitted in the compressing bar and having a polygonal bar on its bottom, and an adjusting board having a polygonal hole and an arc-like hole. The polygonal bar is engaged with the polygonal hole to enable the adjusting board to turn the eccentric shaft for altering the band-compressing stroke.

5 Claims, 10 Drawing Sheets

PACKING MACHINE WITH AN ADJUSTABLE BAND-COMPRESSING STROKE

BACKGROUND OF THE INVENTION

1. Field of the Invention

This invention relates to a packing machine, particularly to one having an adjustable band-compressing stroke.

2. Description of the Prior Art

As shown in FIG. 1, a traditional packing machine with a band-compressing stroke includes a bottom base 1 and a compressing device 2. The compressing device 2 is provided with a compressing handle 3, an eccentric cam 4 connected with an end of the compressing handle 3, a compressing base 5 and a compressing block 6. The eccentric cam 4 is used to squeeze a roller 7 of the compressing base 5. The compressing block 6 is placed under the roller 7. A compression spring 8 is installed beneath the compressing block 6 to form a band-compressed stroke (d) between the compressing block 6 and the bottom base 1 for depositing a clasp and a packing band. When the compressing handle 3 is pressed, the eccentric cam 4 is to squeeze the roller 7 to start rotating and then, the compressing block 6 is to be pushed downward to squeeze the clasp so that the packing band is tightened together. But, the band-compressing stroke (d) of the traditional packing machine is unable to be adjusted so that it cannot meet different thickness for the packing band and the clasp. It may happen that the clasp is unable to tighten the packing band or tightens the packing band excessively to break down the packing band.

SUMMARY OF THE INVENTION

The objective of this invention is to offer a packing machine with an adjustable band-compressing stroke.

The main characteristics of the invention are a compressing base and a compressing device. The compressing base set on the bottom base is provided with an accommodating chamber for installing a pulley. There is a shaft passing through the pulley and two penetrating holes bored respectively in two corresponding sides of the accommodating chamber to enable the pulley to rotate. A compressing block set under the pulley of the compressing base is spaced apart with the compressing base to form the band-compressing stroke. The compressing device consists of a compressing handle, a compressing bar, an eccentric shaft and an adjusting board. The compressing bar is connected with the front end of the compressing handle and put on the pulley. The eccentric shaft fitted with the compressing bar is provided with a polygonal bar projected axially at its bottom. The adjusting board assembled at a preset location of the upper portion of the rear side of the outer shell and is provided with a polygonal hole to fit correspondingly with the polygonal bar of the eccentric shaft and an arc-like hole cut above the polygonal hole for a fixing element to pass through to fix the adjusting board on the upper portion of the outer shell. Via loosening the fixing element to let the adjusting board movable, the eccentric shaft can be turned relatively to alter the band-compressing stroke for different thicknesses of the packing band to achieve a preferred packing strength.

BRIEF DESCRIPTION OF DRAWINGS

This invention is better understood by referring to the accompanying drawings, wherein.

DETAILED DESCRIPTION OF THE PREFERRED EMBODIMENT

Figure 1:
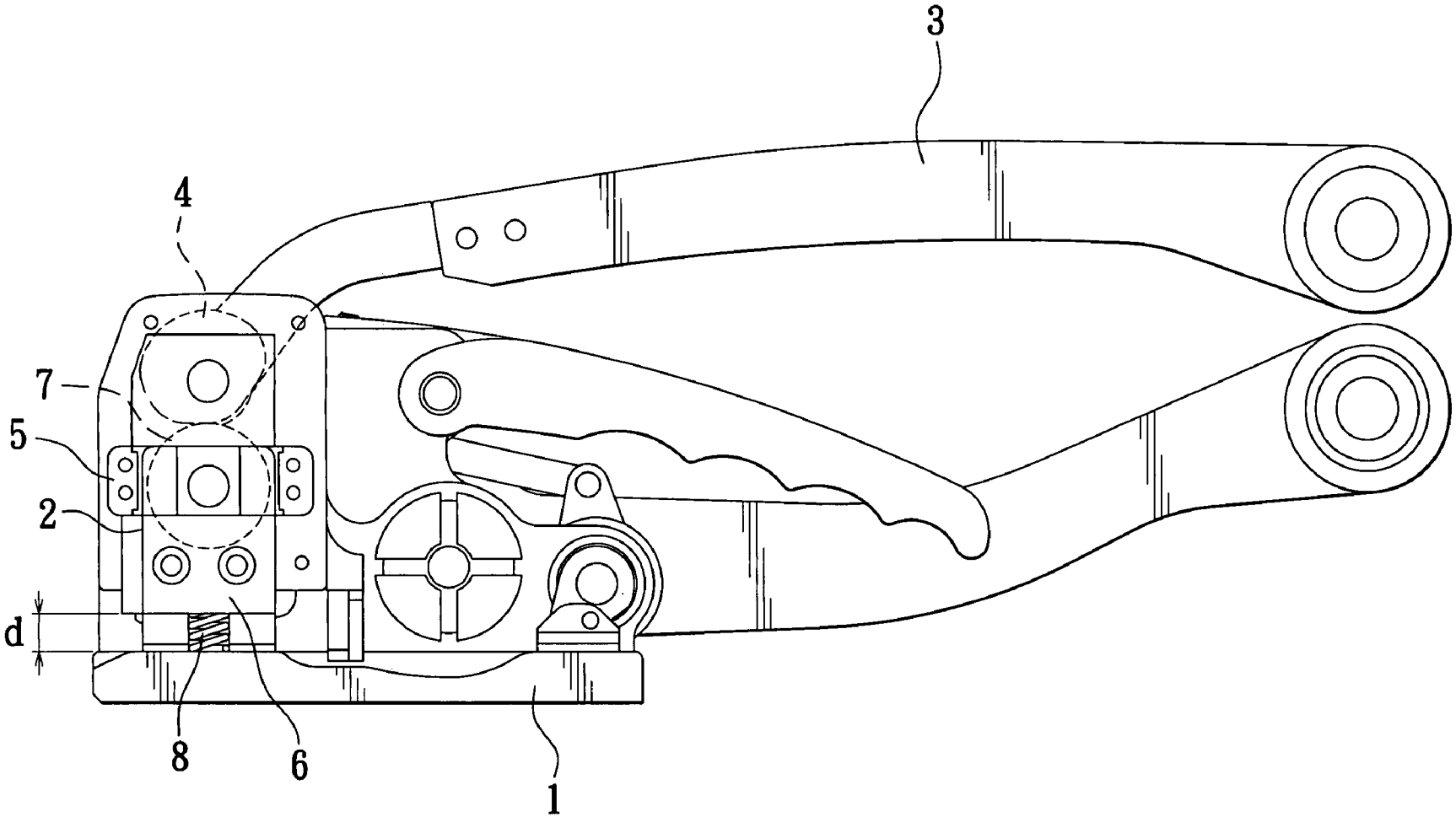
FIG. 1 PRIOR ART
FIG. 1 is a perspective view of a traditional packing machine.
Figure 2:
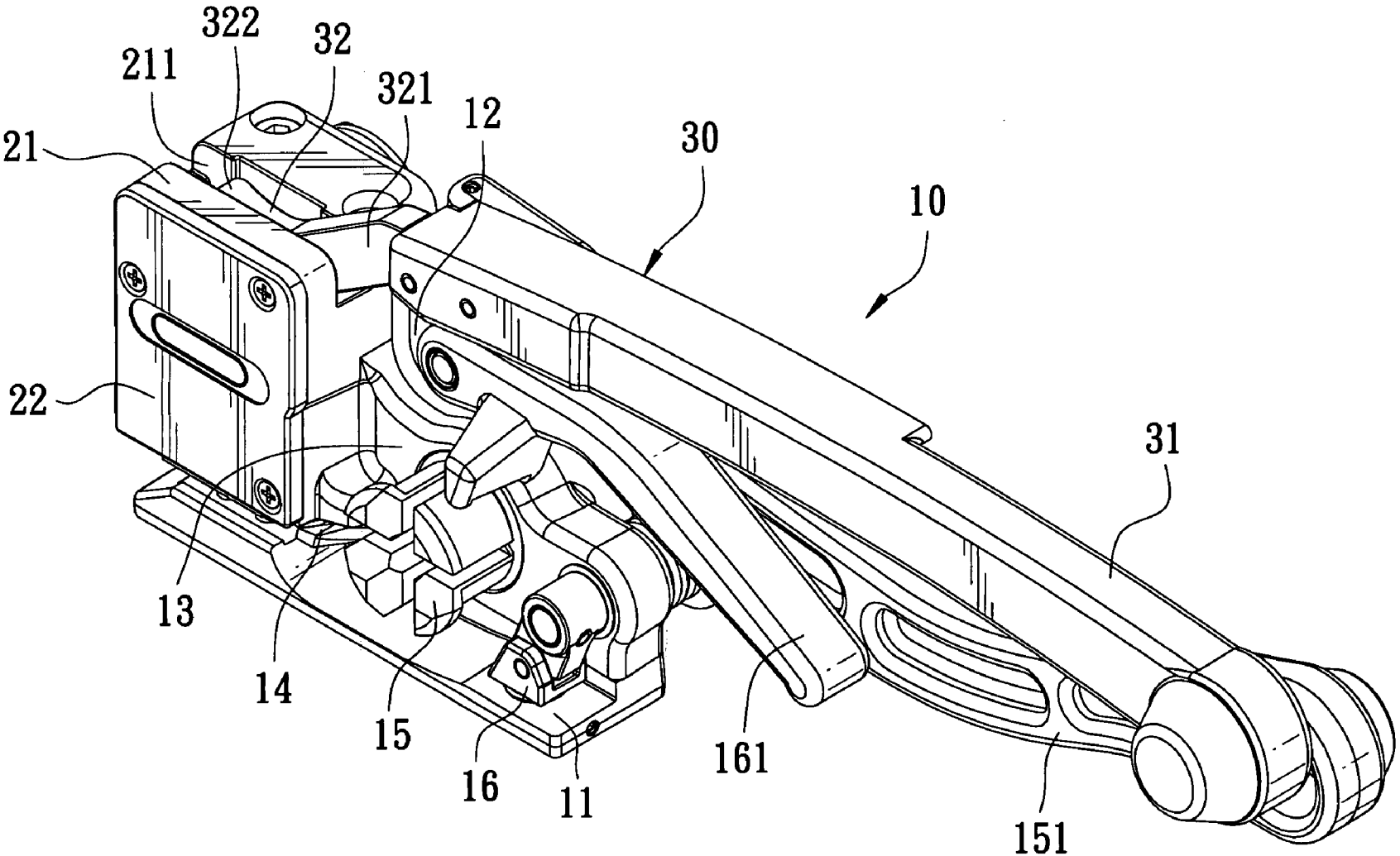
FIG. 2 is a perspective view of a preferred embodiment of a packing machine with an adjustable band-compressing stroke in the present invention.
Figure 3:
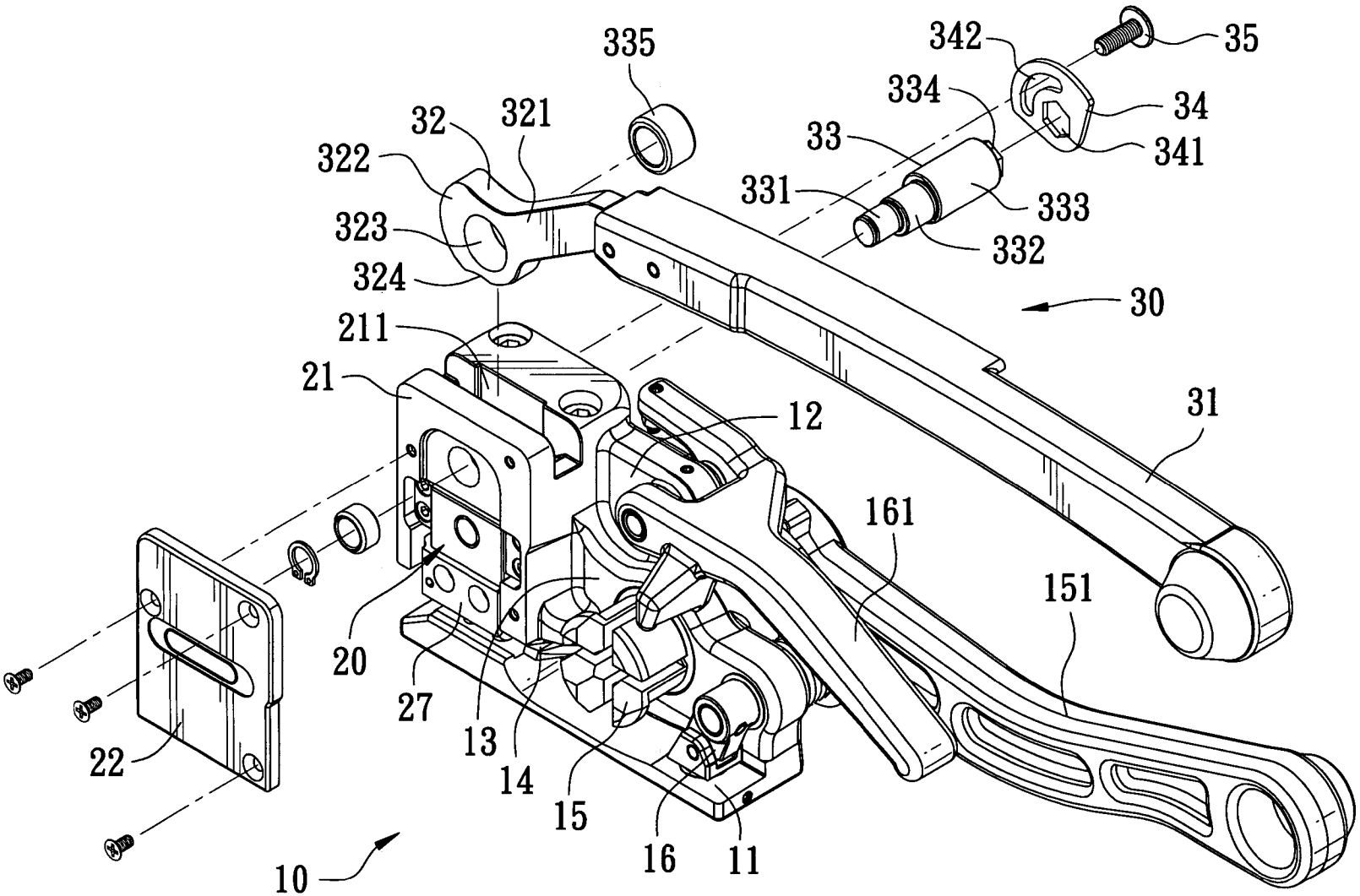
FIG. 3 is a partial exploded perspective view of the preferred embodiment of a packing machine with an adjustable band-compressing stroke in the present invention.
Figure 4:
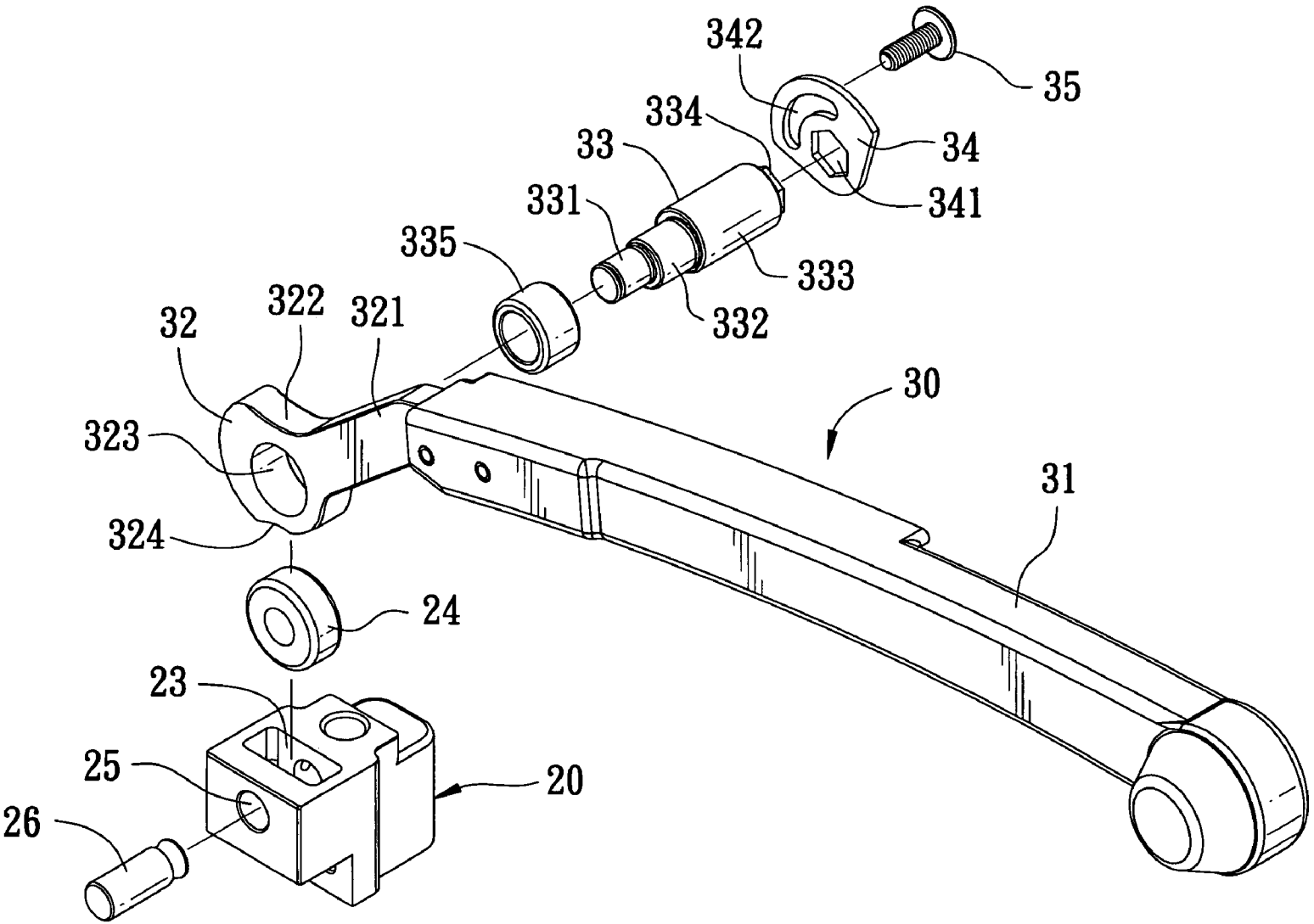
FIG. 4 is an exploded perspective view of a compressing base and a compressing handle of the preferred embodiment of a packing machine with an adjustable band-compressing stroke in the present invention.
Figure 5:
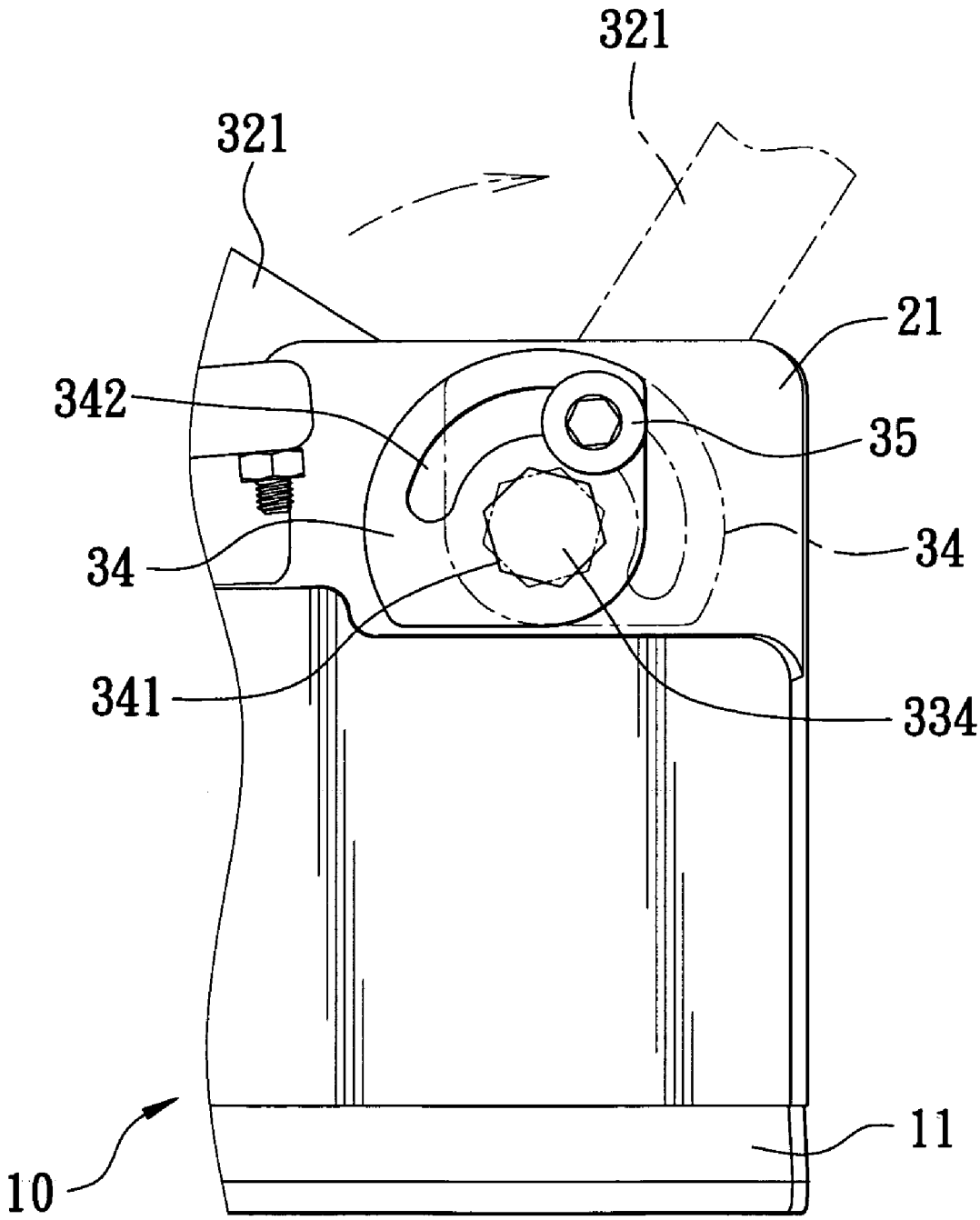
FIG. 5 is an illustrating view of an adjusting board of the preferred embodiment of a packing machine with an adjustable band-compressing stroke in the present invention.
Figure 6:
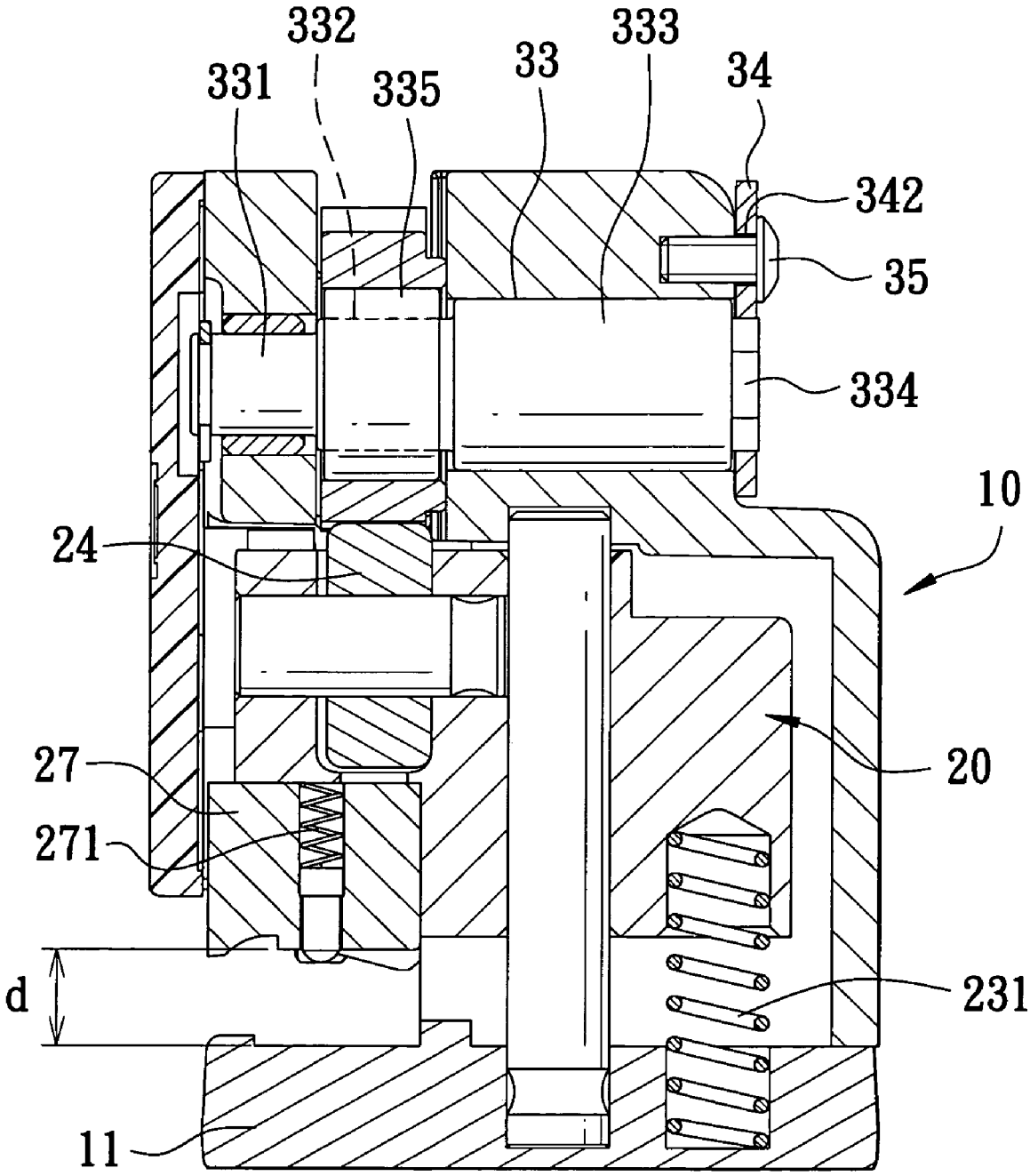
FIG. 6 is a cross-sectional view of the compressing base and a compressing block of the preferred embodiment of a packing machine with an adjustable band-compressing stroke in the present invention.

FIGS. 2~6 show a packing machine 10 with an adjustable band-compressing stroke. The packing machine 10 includes a bottom base 11, an upper board 12 and a lower board 13 installed at one side of the end portion of the bottom base 11, and a cutting device 14, a band-rolling device 15 and a band-guiding device 16 connected in order from left to right at the inner side of the lower board 13. The other side of the lower board 13 is connected with a band-rolling handle 151 corresponding to the band-rolling device 15, able to drive the band-rolling device 15. The upper board 12 is connected with a band-guiding handle 161 to drive the band-guiding device 16. The main characteristic parts are a compressing base 20 and a compressing device 30 described as follows.

The compressing base 20 set on the front portion of the bottom base 11 is provided with an outer shell 21 covered outside and dug horizontally with a guiding slot 211 in its upper portion, and a side cover 22 fixed on its front portion. The compressing base 20 is also provided with an accommodating chamber 23 set in its one side for installing a compression spring 231 that can be compressed down by pressing the compressing base 20 and move it up to its original position automatically after stopping pressing the compressing base 20. A pulley 24, a needle pulley, is installed inside the accommodating chamber 23. The accommodating chamber 23 is bored with a penetrating hole 25 on its two sidewalls respectively to face each other, for a shaft 26 to pass through them and the pulley 24. Set under the pulley 24 is a compressing block 27 that is connected with a compression spring 271 in the interior of its rear portion, able to be compressed down by pressing the compressing base 20 and move it up to its original position automatically after stopping pressing the compressing base 20. The compressing block 27 and the bottom base 11 are separated apart with a gap called band-compressing stroke (d) for depositing a clasp and a packing band.

The compressing device 30 is composed of a compressing handle 31 located above the band-guiding handle 161, a compressing bar 32 fixed with the front end of the compressing handle 31, an eccentric shaft 33 and an adjusting board 34. The compressing bar 32 installed in the guiding slot 211 to lean on the pulley 24 of the bottom base 20 has a rod 321 formed in its rear portion and a deformed head 322 formed irregular in its front portion. The deformed head 322 is cut with an opening 323 and concaved with a recess 324 located at its lower edge to fit correspondingly with the pulley 24 so that the compressing handle 31 and the pulley 24 are to remain immovably while not using. The opening 323 of the deformed head 322 is fitted with a collar 335 for the eccentric shaft 33 to pass through. The eccentric shaft 33 is lathed to have three successive segments, a front shaft portion 331, an intermediate shaft portion 332 and a rear shaft portion 333 with their diameter gradually increased in order. The intermediate shaft portion 332 formed eccentric is to just stay in the collar 335 so that the eccentric shaft 33 can be fitted in the deformed head 322 pivotally, keeping the front shaft portion 331 extended in front of the deformed head 322. The rear shaft portion 333 of the eccentric shaft 33 is projected with a polygonal bar 334 at its bottom. The adjusting board 34 formed like a fan is installed at a preset location of the upper portion of its rear side and provided with a polygonal hole 341 to fit with the polygonal bar 334 of the eccentric shaft 33 so that the adjusting board 34 can drive the eccentric shaft 33 to rotate. In addition, the adjusting board 34 has an arc-like hole 342 cut properly along its arc-like edge above the polygonal hole 341 so as to let a fixing element 35 pass it to fix the adjusting board 34 on a upper portion of the outer shell 21. The fixing element 35 is a screw.

In using, a user can push up the compressing handle 31 to make the compressing bar 32 press down the pulley 24 to start whirling. Then the compressing block 27 is pushed downward to press the clasp so as to tighten the packing band. When the eccentric shaft 33 is to be adjusted with a micro movement, the fixing element 35 has to be first loosened to enable the adjusting board 34 moved along the arc-like hole 342, so that the eccentric shaft 33 can be rotated clockwise or counterclockwise. The fixing element 35 can be screwed to tighten the adjusting board 34 again after adjusting the adjusting board 34. And, when a macro movement is needed, the fixing element 35 and the adjusting board 34 have to be disassembled first, and then, start rotating the polygonal bar 334 clockwise or counterclockwise. It should be noted that an angle of the polygonal bar 334 is defined as a means for the macro adjustment. After adjusted, the adjusting board 34 can be re-assembled by fitting the polygonal hole 341 with the polygonal bar 334 and then, re-screw the fixing element 35 to tighten the adjusting board 34.

Figure 7:
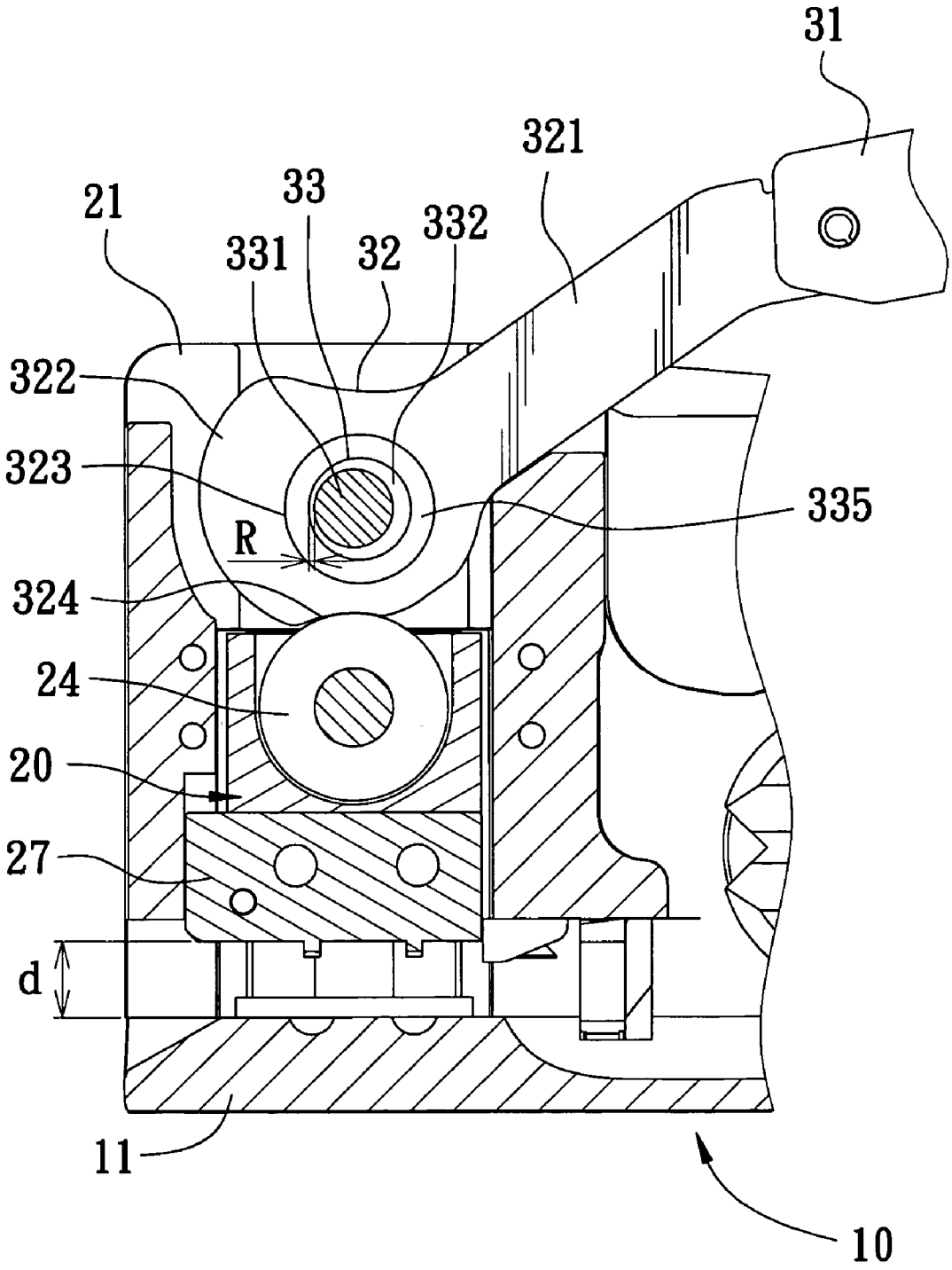
FIG. 7 is a cross-sectional view of the preferred embodiment of a packing machine with an adjustable band-compressing stroke in the present invention, showing a minimum eccentric distance adjusted.
Figure 8:
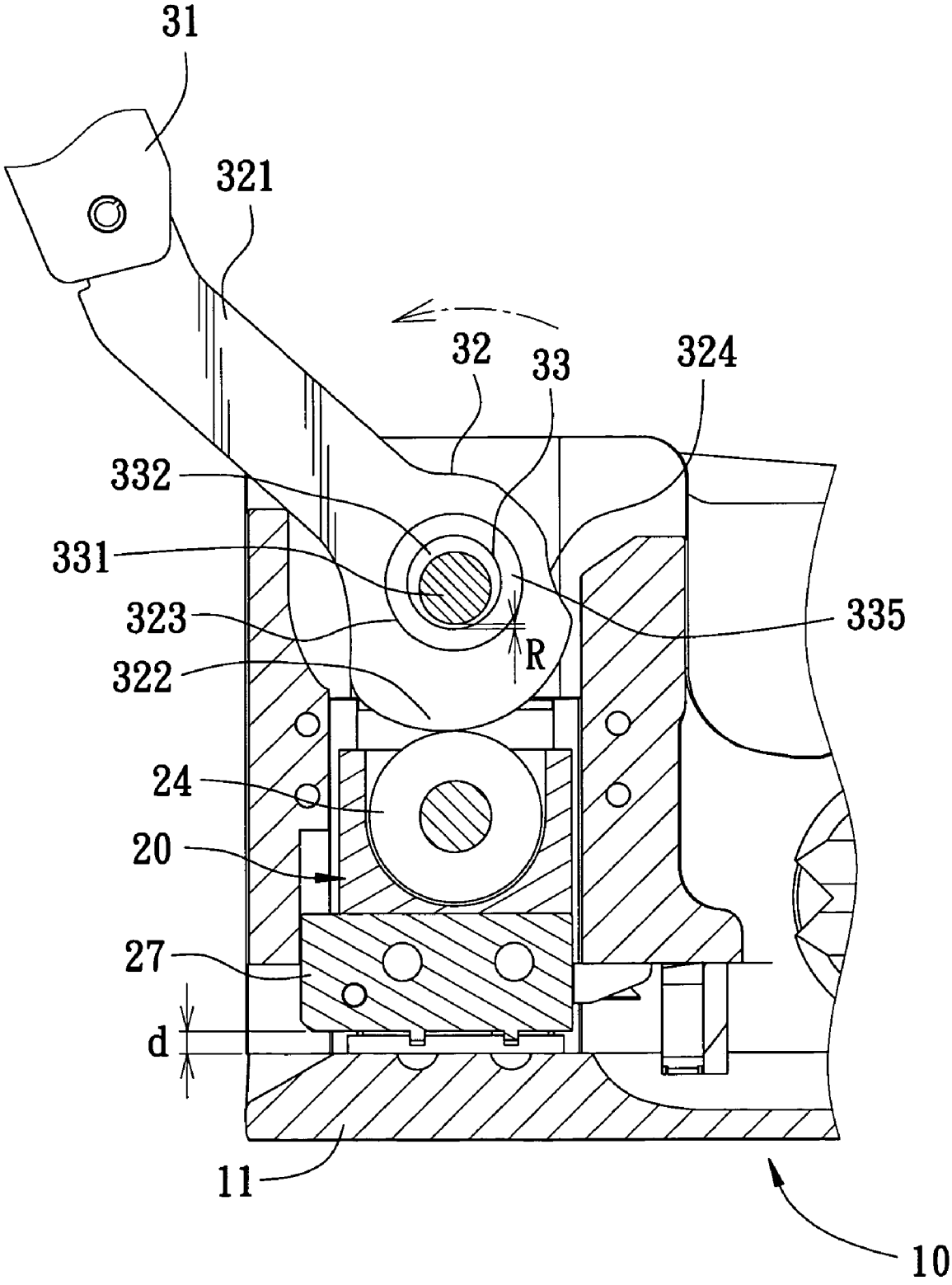
FIG. 8 is a cross-sectional view of the preferred embodiment of a packing machine with an adjustable band-compressing stroke in the present invention, showing the position of the compressing handle pressed on the compressing block while a band-compressing stroke is widened to the maximum.
Figure 9:
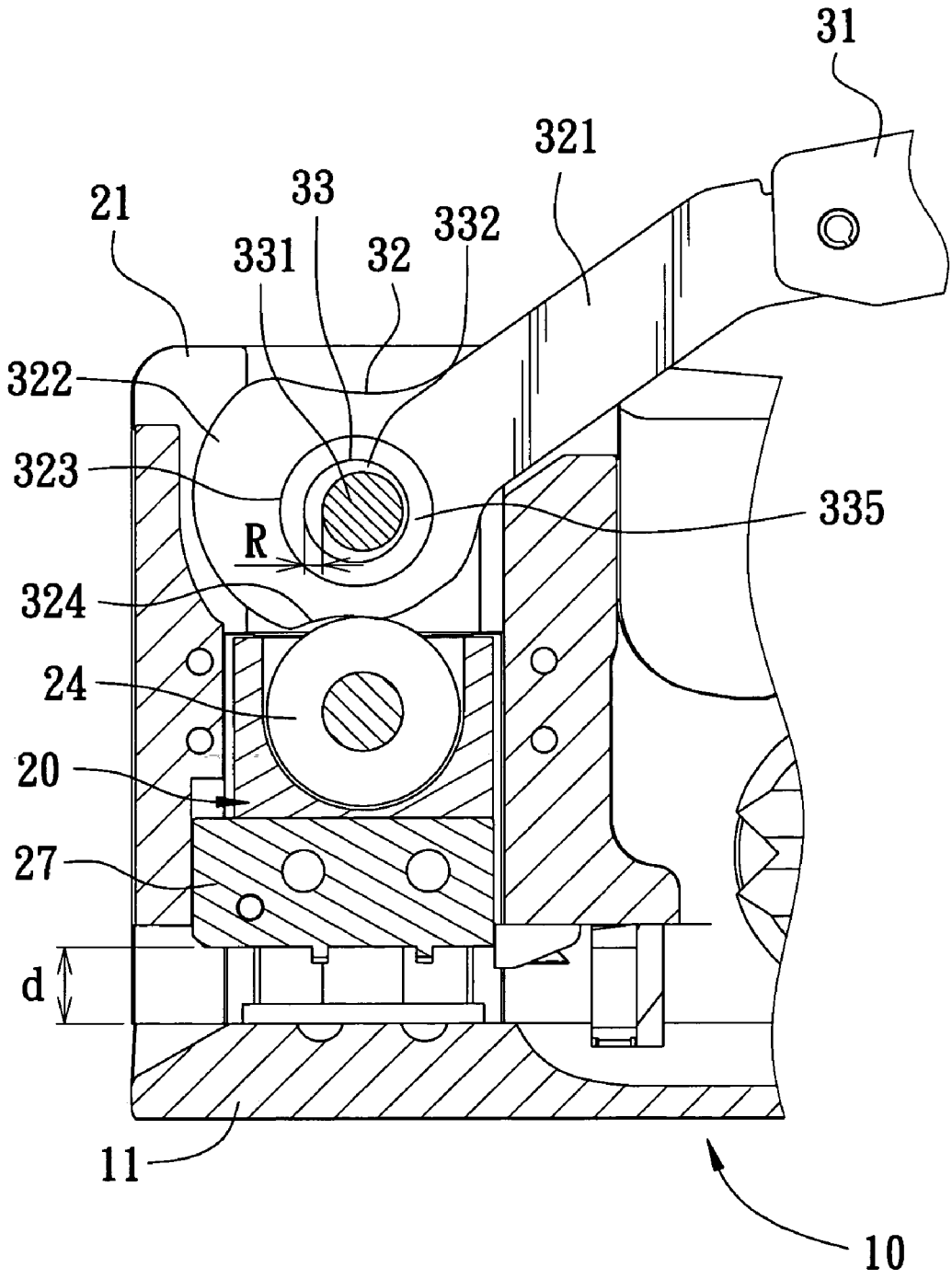
FIG. 9 is a cross-sectional view of the preferred embodiment of a packing machine with an adjustable band-compressing stroke in the present invention, showing a maximum eccentric distance adjusted.
Figure 10:
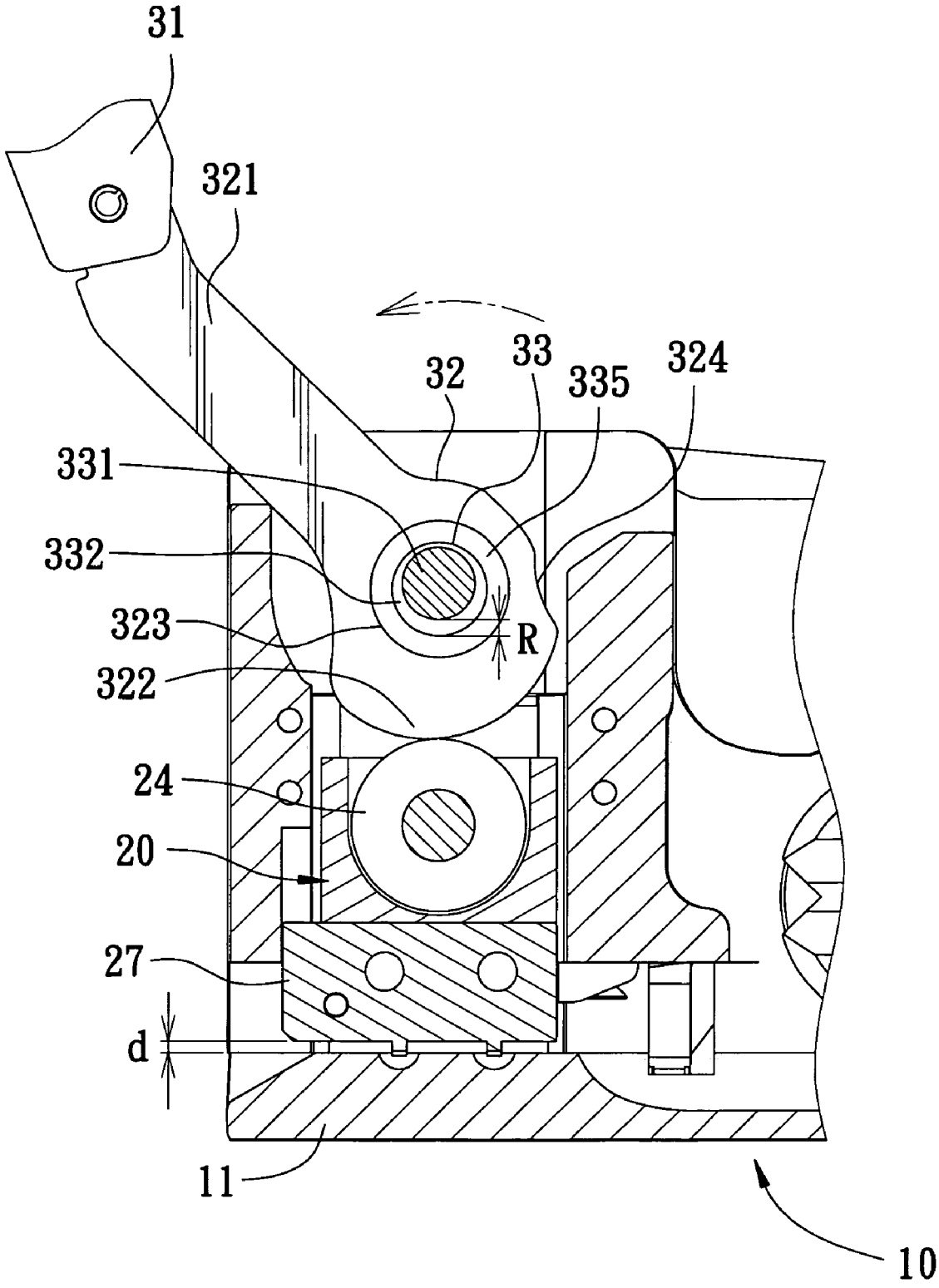
FIG. 10 is a cross-sectional view of the preferred embodiment of a packing machine with an adjustable band-compressing stroke in the present invention, showing the position of the compressing handle pressed on the compressing block while the band-compressed gap is narrowed to the minimum.

As shown in FIGS. 7 and 8, when an eccentric distance R is slightly altered, the pulley 24 is pressed by a little eccentric force, so that the band-compressing stroke (d) is relatively big enough to accept a thicker clasp and a packing band. On the contrary, as shown in FIGS. 9 and 10, the more the eccentric distance R is changed, the more the pulley 24 is to be forced by the compressing handle 31 pushed up, enabling the pulley 24 to rotate clockwise to press down the compressing block 27 more strongly so as to shorten the band-compressing stroke (d), available for compressing a thinner clasp or a packing band. The preferred band-compressed gap d is between 0.8~1 mm.

The invention has the following advantages as can be seen from the foresaid description.

1. The band-compressing stroke (d) can be altered easily by moving the adjusting board 34 to adjust the eccentric distance R. And, a user needs only to move the compressing handle 31 to keep the packing band tightened well by the clasp.

2. The band-compressing stroke (d) can be changed by moving the adjusting board 34 for a micro adjustment and just disassembling the adjusting board 34 and the fixing element 35 to turn the eccentric shaft 33 for the macro adjustment, achieving a quick adjustment of the band-compressing stroke (d).

3. Formed by pivotally connecting the collar 335 with the intermediate shaft portion 332, the eccentric shaft 33 is stably assembled.

While the preferred embodiment of the invention has been described above, it will be recognized and understood that various modifications may be made therein and the appended claims are intended to cover all such modifications that may fall within the spirit and scope of the invention.

What is claimed is:

1. A packing machine with an adjustable band-compressing stroke, said packing machine comprising a bottom base located at its bottom, an upper board and a lower board installed at one side of an end portion of said bottom base, a cutting device and a band-rolling device and a band-guiding device connected in order from left to right at the inner side of said lower board, the other side of said lower board connected with a band-rolling handle corresponding to the band-rolling device that is able to drive said band-rolling device, said upper board connected with a band-guiding handle to drive the band-guiding device, said packing machine executing wrapping, guiding, tightening and cutting of a packing band; and the main characteristic components of said packing machine comprising:

a compressing base set on a front portion of said bottom base and provided with an outer shell covered outside and dug horizontally with a guiding slot in its upper portion, said compressing base having an accommodating chamber for installing a pulley, said accommodating chamber bored with a penetrating hole on its two sidewalls respectively to face each other for a shaft to pass therethrough and said pulley so that said pulley can turn around without displacement, a compressing block set under said pulley, a band-compressing stroke formed between said compressing block and said bottom base for depositing a clasp and a packing band; and a compressing device composed of a compressing handle located above said upper board, a compressing bar fixed with a front end of said compressing handle, an eccentric shaft and an adjusting board, said compressing bar installed in said guiding slot and able to correspondingly press said pulley of said bottom base and having a rod formed in its rear portion and a deformed head formed irregular in its front portion, said deformed head concaved with a recess located at its lower edge for fitting with said pulley and installed with a collar in its center for fitting pivotally with said eccentric shaft, said eccentric shaft having a polygonal bar located axially at its bottom, said adjusting board installed at a preset location of an upper portion of its rear side and provided with a polygonal hole to fit correspondingly with said polygonal bar of said eccentric shaft so that said adjusting board can drive said eccentric shaft to rotate, an arc-like hole cut above said polygonal hole for letting a fixing element pass through to fix said adjusting board on an upper portion of said outer shell.

2. A packing machine with an adjustable band-compressing stroke as claimed in claim 1 wherein said pulley is a needle pulley.

3. A packing machine with an adjustable band-compressing stroke as claimed in claim 1, wherein said eccentric shaft is provided with a front shaft portion, an intermediate shaft portion and a rear shaft portion connected successively, having their diameter gradually increased in order.

4. A packing machine with an adjustable band-compressing stroke as claimed in claim 3, wherein said collar is fitted just with said intermediate shaft portion, and then, both fitted in said deformed head pivotally to keep said front shaft portion extended exposed out of the other side of said compressing bar.

5. A packing machine with an adjustable band-compressing stroke as claimed in claim 1, wherein said fixing element is a screw.

* * * * *